US007654829B1

(12) United States Patent
Chuang et al.

(10) Patent No.: US 7,654,829 B1
(45) Date of Patent: Feb. 2, 2010

(54) ELECTRONIC DEVICE AND CONNECTOR ASSEMBLY

(75) Inventors: I-Cheng Chuang, Taoyuan (TW); Ying-Xing Lee, Taoyuan (TW); Chien-Wei Huang, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 12/416,678

(22) Filed: Apr. 1, 2009

(30) Foreign Application Priority Data

Dec. 9, 2008 (TW) ..... 97222057 U

(51) Int. Cl.
*H01R 12/00* (2006.01)

(52) U.S. Cl. ..... 439/67

(58) Field of Classification Search ..... 439/67, 439/495, 493, 330
See application file for complete search history.

(56) References Cited

U.S. PATENT DOCUMENTS 6,811,431 B2 * 11/2004 Hsieh ..... 439/495
6,969,274 B2 * 11/2005 Kudo et al. ..... 439/495
7,031,104 B1 * 4/2006 Butt et al. ..... 360/97.02
7,248,481 B2 * 7/2007 Trobough ..... 361/785

FOREIGN PATENT DOCUMENTS

JP 7-153531 * 6/1995

* cited by examiner

*Primary Examiner*—Neil Abrams
*Assistant Examiner*—Phuong Nguyen
(74) *Attorney, Agent, or Firm*—Birch, Stewart, Kolasch & Birch, LLP

(57) ABSTRACT

A connector assembly includes a circuit board, a housing, terminals, a flexible circuit board and a reinforcement plate. The housing has a depression portion and is disposed on the circuit board. The depression portion has a first opening and a second opening adjacent to the first opening, and the terminals are disposed in the depression portion and electrically connected to the circuit board. The flexible circuit board has a first surface, a second surface and pads disposed on the first surface, and the reinforcement plate is disposed on the second surface near one end of the flexible circuit board, wherein when the flexible circuit board is joined to the housing and the first opening faces to the flexible circuit board, the pads contact the terminals, whereby the flexible circuit board is electrically connected to the circuit board, and the flexible circuit board extends from the housing via the second opening.

5 Claims, 4 Drawing Sheets

ELECTRONIC DEVICE AND CONNECTOR ASSEMBLY

CROSS REFERENCE TO RELATED APPLICATIONS

This Application claims priority of Taiwan Patent Application No. 097222057, filed on Dec. 9, 2008, the entirety of which is incorporated by reference herein.

BACKGROUND OF THE INVENTION

1. Field of the Invention

The invention relates to a connector assembly, and in particular relates to a connector assembly comprising a circuit board and a flexible circuit board.

2. Description of the Related Art

A conventional connection between a circuit board and a flexible circuit board utilizes ZIF connector, as shown in FIGS. 1 and 2. The ZIF connector 10 is installed on a circuit board (not shown). A space 12 is formed in the ZIF connector 10. Several terminals 14 are disposed in the space 12. A reinforcement plate 22 is disposed on one end of the flexible circuit board 20. The reinforcement plate 22 is inserted into the space 12 of the ZIF connector 10 along with the flexible circuit board 20, whereby the flexible circuit board 20 is positioned in the ZIF connector 10. At this time, the pads 24 of the flexible circuit board 20 contact the terminals 14 of the ZIF connector 10, whereby the flexible circuit board 20 is electrically connected to the circuit board. In such a structure, the flexible circuit board 20 easily escapes from the ZIF connector 10 when the flexible circuit board 20 is pulled during assembly process.

FIG. 3 depicts another conventional connector assembly comprising a board to board connector 10' disposed on a circuit board (not shown). A depression portion 12' is formed on the connector 10'. A reinforcement plate 22' is disposed on a first surface near the end of the flexible circuit board 20'. A connector 24' is disposed on a second surface opposite to the reinforcement plate 22'. The shape of the connector 24' is mated with the depression portion 12'. When the flexible circuit board 20' is needed to connect to the circuit board, the connector 24' engages the depression portion 12'. Pads and terminals are disposed on the connector 24' and the depression portion 12', respectively. The pads contact the terminals to achieve the electrical connection of the flexible circuit board 20' and the circuit board. In such a structure, although the reinforcement plate is made of metal which is reliable, both the circuit board and the flexible circuit board have specific structures, which cause high cost and thickness issue.

BRIEF SUMMARY OF INVENTION

An embodiment of a connector assembly comprises a circuit board, a housing, terminals, a flexible circuit board and a reinforcement plate, wherein the housing has a depression portion and is disposed on the circuit board. The depression portion has a first opening and a second opening adjacent and perpendicular to the first opening, and the terminals are disposed in the depression portion and electrically connected to the circuit board. The flexible circuit board has a first surface, a second surface and pads disposed on the first surface, and the reinforcement plate is disposed on the second surface near one end of the flexible circuit board, wherein when the flexible circuit board is joined to the housing, and the first opening faces to the flexible circuit board, the pads contact the terminals, whereby the flexible circuit board is electrically connected to the circuit board, and the flexible circuit board extends from the housing via the second opening.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 4:
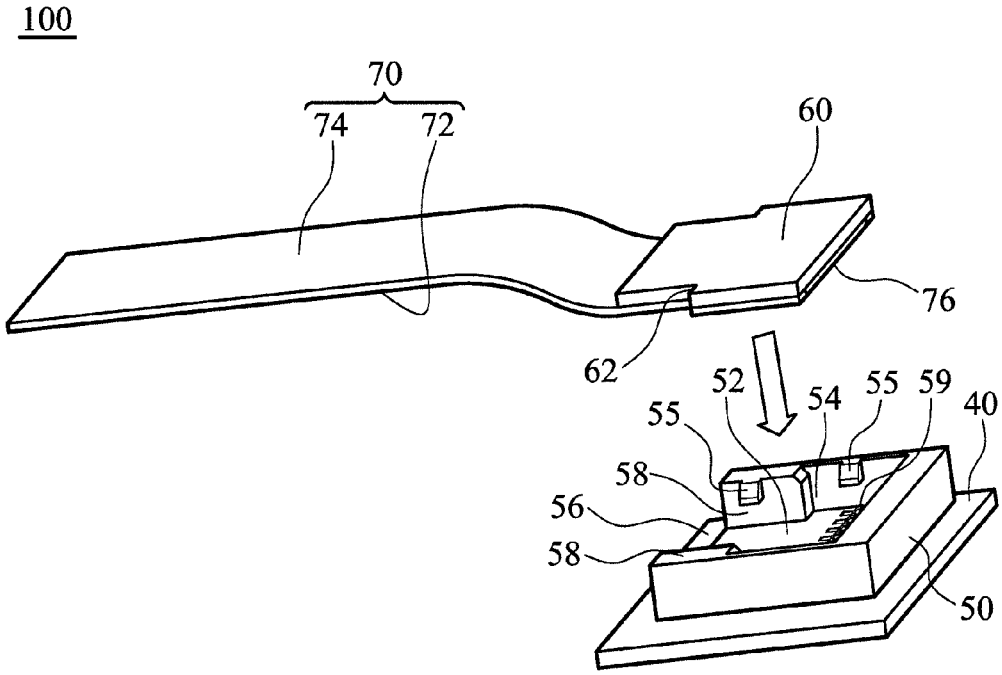
FIG. 4 is an exploded view of a connector assembly according to one embodiment of the invention.

Referring to FIG. 4, a connector assembly 100 comprises a circuit board 40, a housing 50, a reinforcement plate 60 and a flexible circuit board 70. The housing 50 is a rectangular, solid and disposed on the circuit board 40. The housing 50 is made of insulating material. The housing 50 has a depression portion 52 which is substantially rectangular. The depression portion 52 has a first opening 54 and a second opening 56 adjacent to the first opening 54. The first opening 54 is formed on the top of the housing 50, and the second opening 56 is formed on the lateral side of the housing 50. Two stoppers 58 are disposed on a wall of the depression portion 52 and near the second opening 56. A plurality of terminals 59 are disposed on the bottom of the depression portion 52 and electrically connected to the circuit board 40.

The flexible circuit board 70 has a first surface 72 and a second surface 74. The reinforcement plate 60 is disposed on the second surface 74 and near one end of the flexible circuit board 70. A plurality of pads 76 is disposed near the edge of the first surface 72 and a plurality of terminals 59 is disposed on the bottom of the depression portion 52. The terminals 59 can be many types, as long as they are maintained to have stable contact with the pads 76. For example, the terminals in SIM card connector can be applied. In addition, the reinforcement plate 60 has two shoulders 62, which make the reinforcement plate 60 to have a T-shape.

When the flexible circuit board 70 is joined to the housing 50, the reinforcement plate 60 enters the depression portion 52 via the first opening 54 and pushes the engaging portions 55 disposed on the depression portion 52 and the stopper 58 to be engaged by the engaging portion 55, whereby the reinforcement plate 60 is fixed by the engaging portion 55 and first opening 54 faces the flexible circuit board 70 so that the pads 76 contact the terminals 59 to achieve electrical connection. At this time, the flexible circuit board 70 extends from the housing 50 via the second opening 56, and the shoulders 62 abut the stoppers 58, which prevent the reinforcement plate 60 from escaping from the housing 50 via the second opening 56. The engaging portion 55 prevents the reinforcement plate 60 from escaping the housing 50 via the first opening 54.

Figure 1:
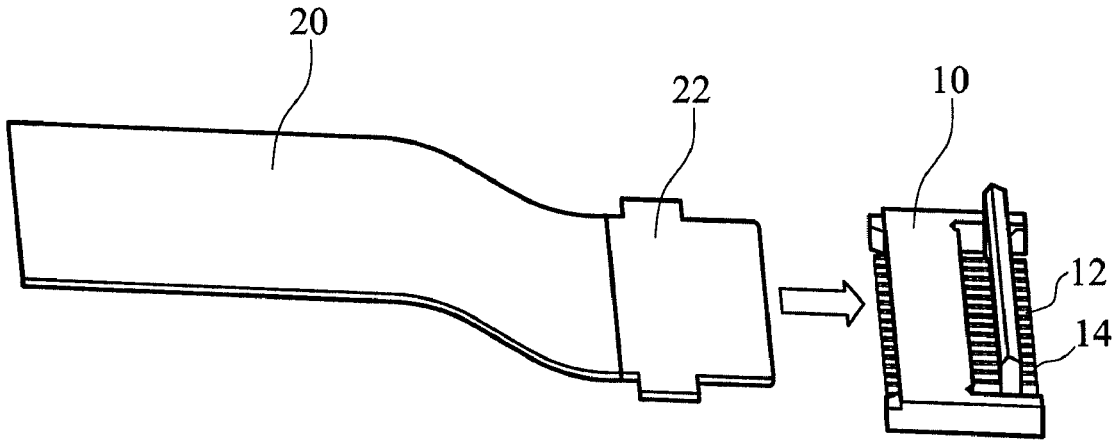
FIG. 1 ( PRIOR ART )
FIG. 1 is a schematic view showing a conventional ZIF connector connecting a flexible circuit board and a circuit board.
Figure 2:
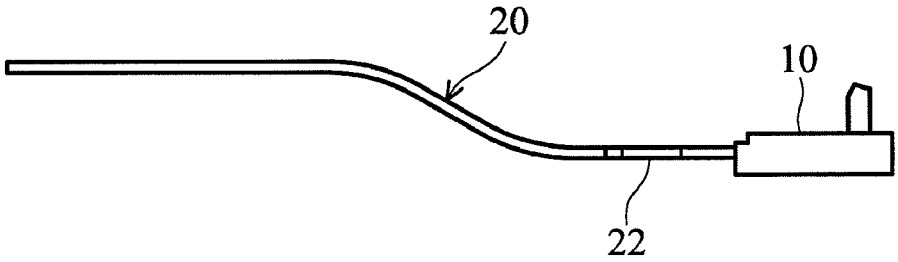
FIG. 2 ( PRIOR ART )
FIG. 2 is a schematic view showing the connection of the conventional ZIF connector and the flexible circuit board.
Figure 3:
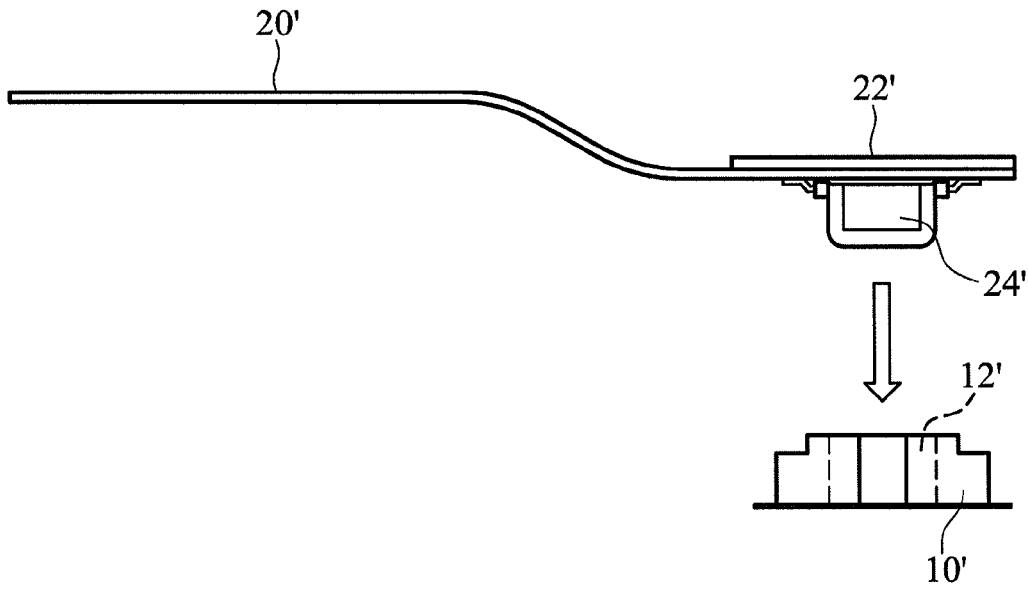
FIG. 3 ( PRIOR ART )
FIG. 3 is a schematic view showing another conventional connector connecting a flexible circuit board and a circuit board.
Figure 5:
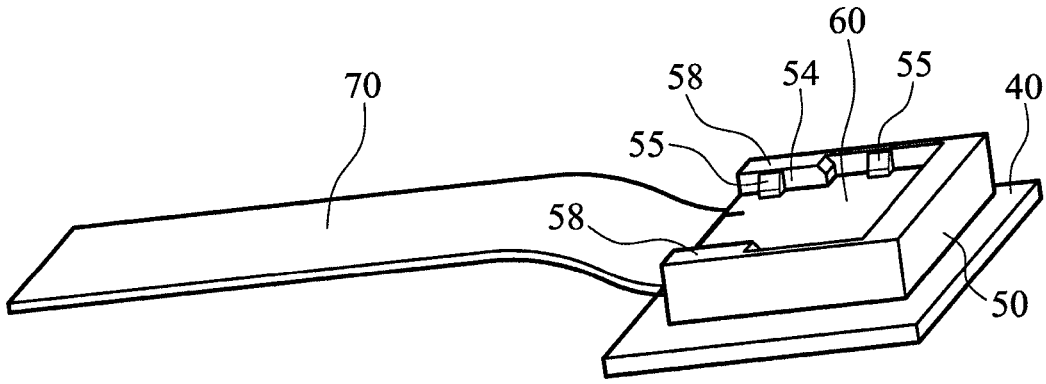
FIG. 5 is a schematic view of a connector assembly as shown in FIG. 4.

In such a structure, when the flexible circuit board 70 is pulled, the flexible circuit board 70 does not escape from the housing 50 in the direction, i.e. the direction the flexible circuit board 70 is extending, as shown in FIG. 5. The connector assembly of the present embodiment is more reliable than the conventional structure in FIG. 1 and has a smaller thickness than the structure in FIG. 3.

In the embodiment, since the pads 76 are disposed on the surface opposite to the reinforcement plate, the reinforcement plate can be made of metal, which has high strength and better ESD and EMI ability. The connector assembly 100 of the present embodiment can be applied to various electronic devices. For example, the connector assembly 100 can be applied to portable devices such as cell phones, PDAs, UMPC, and laptops. The connector assembly 100 can also be applied to desktop or other stationary devices.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A connector assembly, comprising a circuit board;

a housing disposed on the circuit board and having a depression portion, wherein the depression portion comprises a first opening and a second opening adjacent and perpendicular to the first opening;

a plurality of terminals disposed in the depression portion and electrically connected to the circuit board;

a flexible circuit board comprising a first surface, a second surface and a plurality of pads disposed on the first surface; and a reinforcement plate disposed on the second surface near one end of the flexible circuit board, wherein when the flexible circuit board is joined to the housing and the first opening faces the flexible circuit board, and, the pads contact the terminals, whereby the flexible circuit board is electrically connected to the circuit board, and the flexible circuit board extends from the housing via the second opening, wherein the housing has at least one stopper disposed near the second opening, and the reinforcement plate has at least one shoulder; when the reinforcement plate is joined to the depression portion, the shoulder abuts the stopper, whereby the reinforcement plate is maintained in the depression portion.

2. The connector assembly as claimed in claim 1, wherein the reinforcement plate comprises metal.

3. An electronic device comprising the connector assembly claimed in claim 1.

4. The connector assembly as claimed in claim 1, wherein the housing has an engaging portion disposed in the depression portion; when the reinforcement plate is joined to the depression portion, the engaging portion engages the reinforcement plate, whereby the reinforcement plate is positioned in the depression portion.

5. The connector assembly as claimed in claim 4, wherein the housing further has at least one stopper disposed near the second opening, and the reinforcement plate has at least one shoulder; when the reinforcement plate is joined to the depression portion, the shoulder abuts the stopper, whereby the reinforcement plate is maintained in the depression portion.

* * * * *